United States Patent [19]

Rogers, Jr.

[11] Patent Number: 4,544,201

[45] Date of Patent: Oct. 1, 1985

[54] ROCKING AND RECLINER CHAIRS

[75] Inventor: Walter C. Rogers, Jr., Denton, N.C.

[73] Assignee: Parma Corporation, Denton, N.C.

[21] Appl. No.: 534,625

[22] Filed: Sep. 15, 1983

Related U.S. Application Data

[63] Continuation-in-part of Ser. No. 480,255, Mar. 30, 1983.

[51] Int. Cl.[4] ..... A47C 1/02

[52] U.S. Cl. ..... 297/271; 297/68; 297/84; 297/DIG. 7

[58] Field of Search ..... 297/83, 84, 85, 86, 297/87, 89, 68, DIG. 7, 282, 271, 261

[56] References Cited

U.S. PATENT DOCUMENTS

| | | | |
|---|---|---|---|
| 463,863 | 11/1891 | Johnson | 297/282 X |
| 766,836 | 8/1904 | Miller et al. | 297/282 |
| 3,093,409 | 6/1963 | Fletcher | 297/261 X |

FOREIGN PATENT DOCUMENTS

| | | | |
|---|---|---|---|
| 136657 | 2/1933 | Austria | 297/83 |

*Primary Examiner*—James T. McCall
*Attorney, Agent, or Firm*—William E. Mouzavires

[57] ABSTRACT

A rocking chair whose rocking action is achieved solely through a linkage mechanism rather than rocking cams conventionally employed. In one embodiment, the chair includes upholstered seat, backrest and armrests which are united in a one-piece structure mounted on a fixed base by means of the linkage mechanism. In the preferred embodiment, the base is provided with a swivel enabling the chair to swivel about a vertical axis. The linkage mechanism allows it to be mounted within the seat frame into a compact space which permits low seat styling and yet, the linkage mechanism is concealed and still functions to provide stable rocking as well as gliding action. In another embodiment, the chair is provided with a footrest and the seat is moveable relative to the swivel into a reclining position when the footrest is extended. Additionally, the backrest may be either fixed to the seat in the manner of a "one-way" recliner or moveable relative to the seat as in a "three-way" recliner chair.

11 Claims, 6 Drawing Figures

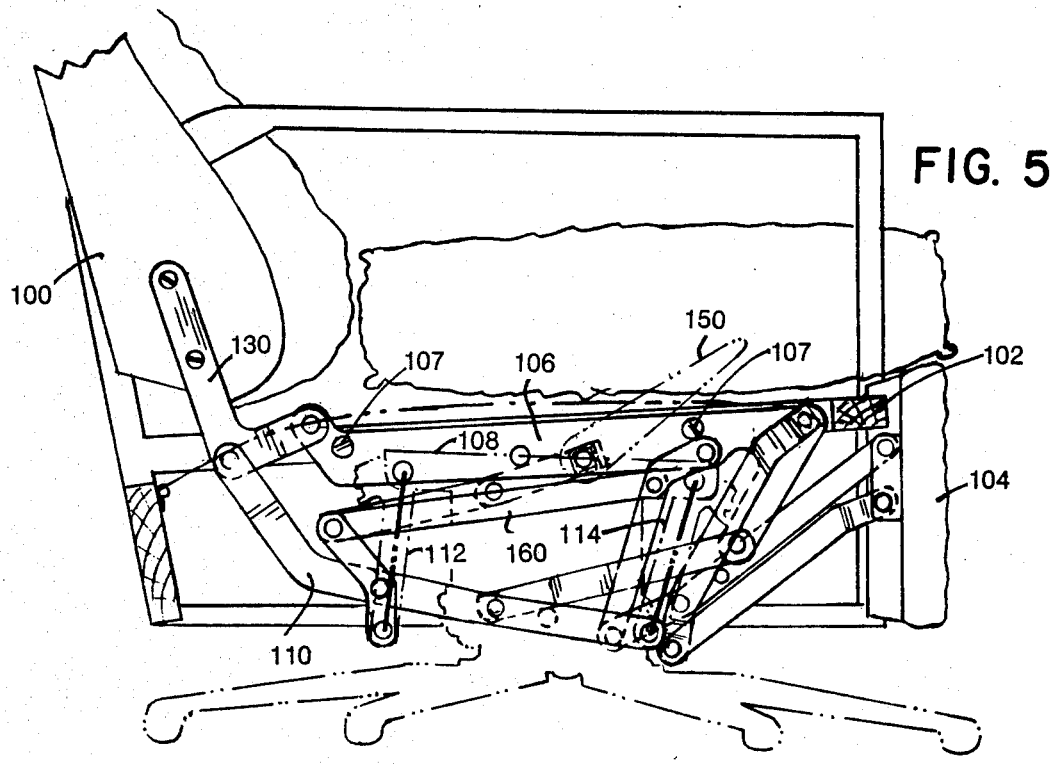
FIG. 5
FIG. 6
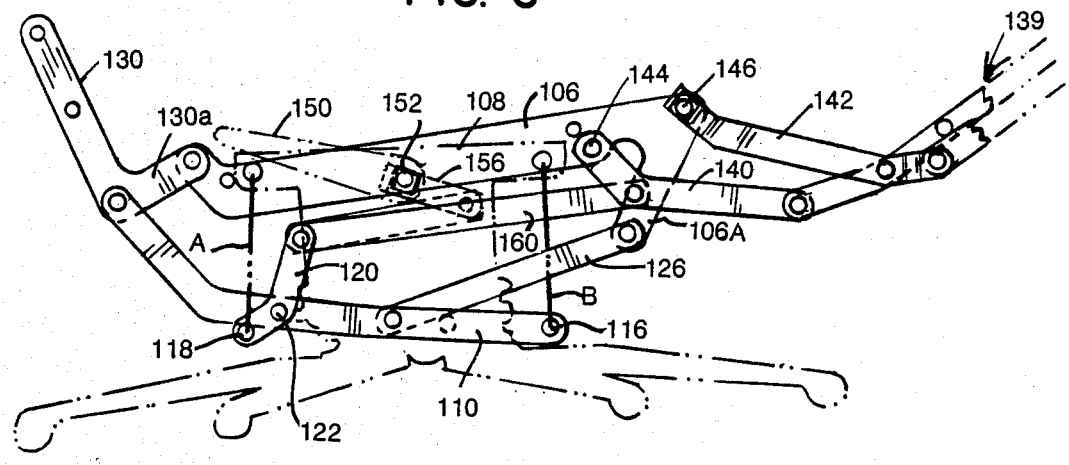

ROCKING AND RECLINER CHAIRS

BACKGROUND OF INVENTION

Various types of rocking chairs have, of course, existed for many years. One type utilizes cams or cam surfaces rockable on the floor or a platform such as in a platform rocker. Another type rocks about a fixed axis such as is in a so-called "rocker-box" chair. In yet another type of rocking chair, the chair is suspended from swing arms located externally of the sides of the chair. It is this general category of chair to which the present invention is directed.

OBJECTS OF INVENTION

It is an object of the present invention to provide an improved rocking chair that may be upholstered and designed to meet present-day styling requirements including low seat styling.

It is a further object of the present invention to provide such a chair as described above and will also provide comfortable and stable rocking and gliding action.

A further object of the present invention is to provide a rocking chair that utilizes a linkage mechanism to achieve rocking and gliding action and yet the linkage mechanism is totally concealed within the chair below the seat without sacrificing safety or styling requirements. Included herein is such a chair that may be designed with low-seat styling unimpaired by the linkage mechanism incorporated therein.

A still further object of the present invention is to provide a novel and improved linkage mechanism that may be incorporated in an upholstered chair to provide rocking action.

Yet another object of the present invention is to provide such a rocking chair that is capable of rocking and gliding action while incorporating a footrest and backrest and seat units in the manner of either a "one-way" or "three-way" recliner chair. Included herein are novel linkage mechanisms that may be incorporated in the aforementioned chair.

SUMMARY OF INVENTION

In summary, the rocking chair of the present invention includes a seat, armrest and backrest structure mounted on a fixed base by a linkage mechanism. In one embodiment, the latter includes a seat link fixed to the seat frame along the side rail thereof, a stationary base link fixed on the base at a location above the seat link, and a pair of swing arms pivoted at their opposite ends to the seat and base links. The distance between the swing arm pivots on the seat frame is less than the distance between the pivots on the base link and these distances are designed with ratios within a predetermined range to provide safe and effective rocking and gliding action. The seat, armrest and back structure may be upholstered as desired and furthermore, the linkage mechanism may be designed in a compact size allowing low-seat styling in accordance with prevailing tastes.

In another embodiment, the chair is provided with a footrest and the backrest and seat are moveable into a reclining position when the footrest is extended. Additionally, the backrest may be incorporated to be moveable relative to the seat as in a "three-way" reclining chair or to be fixed relative to the seat as in a "two-way" reclining chair.

DRAWINGS

Other objects and advantages of the present invention will become apparent from the following more detailed description taken in conjunction with the attached drawings in which:

FIG. 5 is a side elevational view of a rocking chair constituting another embodiment of the present invention shown with a footrest in closed position; and FIG. 6 is a view generally similar to FIG. 5 but with the footrest in extended position, and with parts removed.

DETAILED DESCRIPTION

Figure 1:
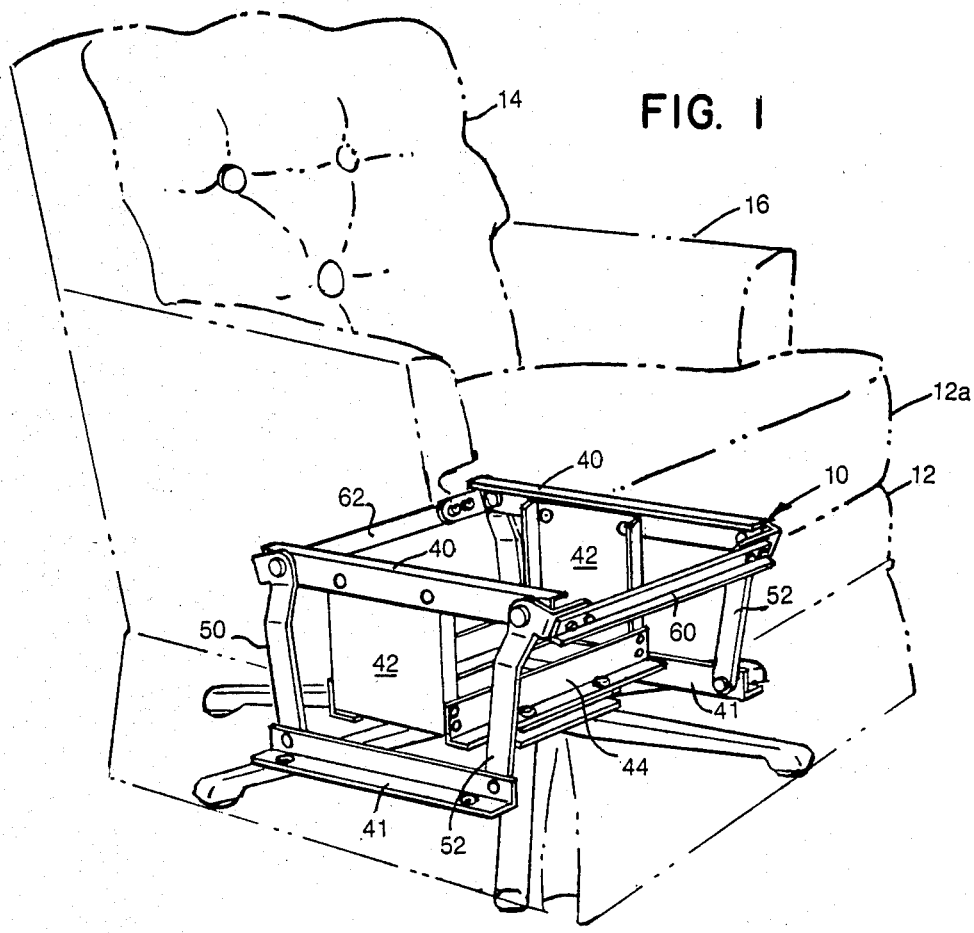
FIG. 1 is a perspective view of a rocking chair embodying the present invention with the upholstered portions thereof shown in phantom lines.
Figure 2:
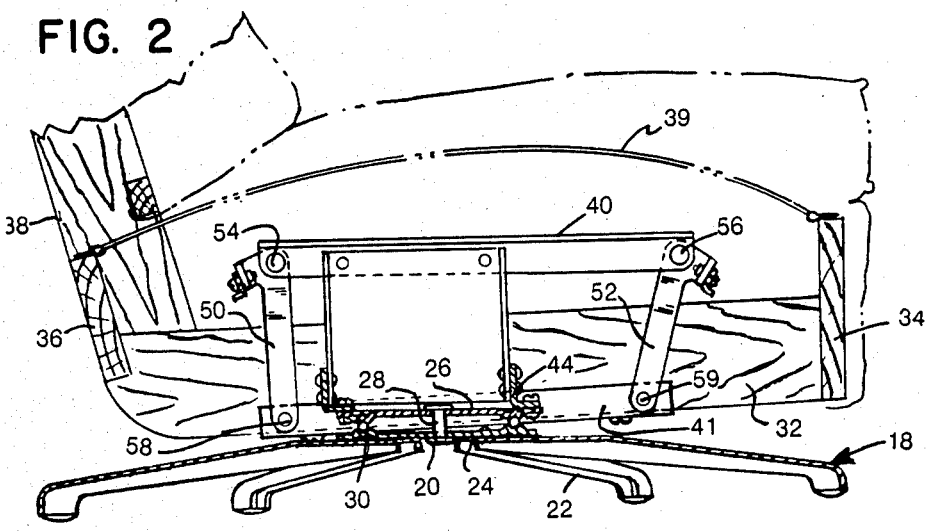
FIG. 2 is a cross-sectional side view of the chair with a part of the backrest broken away.

Referring now to the drawings in detail, there is shown for illustrative purposes only in FIGS. 1 through 4, a rocking chair embodying the present invention. Referring to FIG. 2, the basic parts of the chair include a seat 12, backrest 14 and armrests 16 which, in the specific embodiment, are united together as one structure. In accordance with the invention, this structure is mounted on a base generally designated 18 by means of a novel and improved linkage mechanism generally designated 10 which allows the chair to rock as well as glide relative to the base 18. In the specific embodiment, base 18 includes a swivel generally designated 20 (see FIG. 2) for also providing swiveling motion of the chair about a vertical axis relative to the base. Swivel 20 may include any conventional or other suitable structure such as, for example, upper and lower plates 24 and 26 mounted about a central swivel pin 28 with ball bearings and races generally designated 30 formed between the swivel plates 24 and 26 in typical fashion. The lower swivel plate 24 is fixed to the underlying base structure 18 to be stationary while the upper swivel plate 26 is rotatable about the axis of the swivel pin 28 relative to the lower plate 24 and underlying base structure 18. Although base 18 in the specific embodiment shown includes a plurality of spider legs 22 radiating outwardly from a central area, it will be appreciated that any other suitable base structure may be employed.

Referring now to FIG. 2, seat 12 may have any suitable or conventional frame construction including, for example, side rails 32 (one shown) interconnected by a front rail 34 and a back rail 36 which is also secured against a backrest frame including a rail 38 as shown in FIG. 2. The frame parts just mentioned may be made from wood, as shown, or any other suitable material. Additionally, any conventional seat springs such as designated 39 may be employed. It is preferred that the chair parts be upholstered such as shown for illustrative purposes only in the drawings, so that the linkage mechanism 10, to be described below, will be completely concealed within the chair. Additionally, in accordance with the invention, the chair may be designed to possess a relatively low-seat styling meaning that the seat is positioned from floor within a certain minimum range. The chair, of course, may also include a seat cushion illustrated at 12*a* in FIG. 1 and moreover, the chair may include T-cushion styling where the front ends of seat cushion 12 are positioned beyond the front of armrests 16.

Referring now to FIGS. 1 and 2, linkage mechanism 10 in the preferred embodiment includes a pair of base links 40 fixed relative to the base as will be described, and a pair of seat links 41 fixed respectively to the opposite side rails 32 of the seat frame, preferably on the inner sides thereof. As clearly shown in FIG. 1, seat links 41 are formed as right-angle members so that they may be secured by fasteners through the base thereof and into the bottom surface of seat side rails 32 as best shown in FIG. 2.

The base links 40 are located above the seat links 41 and fixed relative to the base 18 by means of extension members generally designated 42 which, in the specific embodiment shown, are plate members extending in opposite vertical planes from the upper swivel plate 26 to which they are attached by cross members 44, the latter being shown as angle-shaped to provide legs for securing the same to the extensions 42 and swivel plate 26. It will thus be seen that the base links are united with the upper swivel plate 26 to be rotatable about the axis of the swivel pin 28 relative to the lower swivel plate 24 and its associated base structure 22.

Seat 12 is suspended from base links 40 by means of swing arms 50, 52, whose opposite ends are mounted for pivotal or rotational movement to the base link and seat link 41; there being, of course, two pairs of links 50 and 52 mounted to the base links 40 and seat links 41 on opposite sides of the chair. Swing link 50 which, relatively speaking, is pivotally interconnected at the rear end portions of the seat and base links and may be termed a "rear swing link", is pivoted at joint 54 to the base link and at joint 58 to the seat link. The front swing link 52 is pivoted at joint 56 to the base link and at joint 59 to the seat link. In order to provide a minimal tolerance in the pivot joints, it is preferred that they be formed by ball joints rather than pivot pins or rivets conventionally employed in chair linkage mechanisms. This minimizes, if not avoids, undesired noise and bump during motion of the chair that would otherwise be caused by the slack attendant conventional pivot pin joints presently in use in chair mechanisms.

In the preferred embodiment, the swing arms 50, 52 on opposite sides of the chair are interconnected by bars 62 and 60 to integrate the swing arms as well as to reinforce the same against side-sway. In the specific embodiment shown, the upper ends of swing arms 50 and 52 are provided with inwardly projecting flanges to which the bars 60 and 62 are fixed in any suitable fashion.

Figure 3:
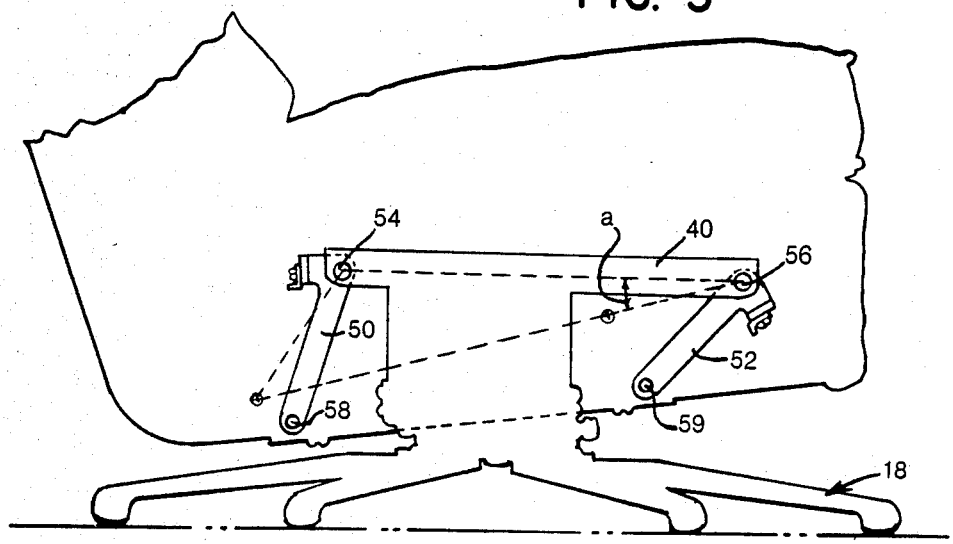
FIG. 3 is a diagrammatic side view of the chair shown in a rearwardly rocked position.
Figure 4:
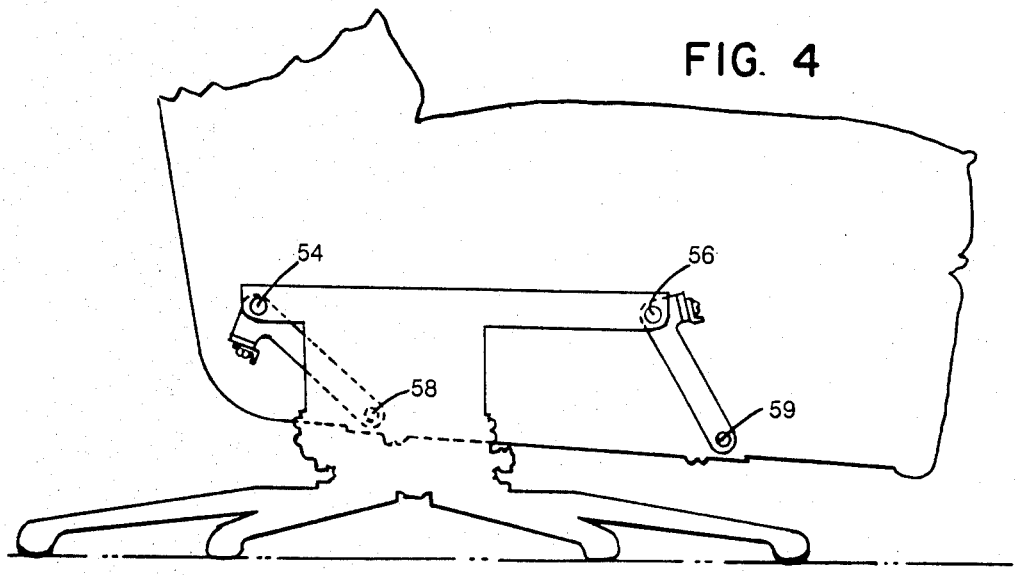
FIG. 4 is a view similar to FIG. 3 but with the chair shown in a forwardly rocked position.

In order to provide rocking action of the seat relative to the base as opposed to purely translatory motion, it is necessary that the distance between the upper pivots 54 and 56 be greater than the distance between the lower pivots 58, 59. It will thus be seen that one occupying the chair may rock the seat and back structure to and fro relative to the base 22 by virtue of the swinging movement of swing arms 50, 52 relative to the seat and base structures. This is illustrated in FIGS. 3 and 4. Moreover, through the use of the swing arms 50, 52, the seat structure also is displaced in the horizontal direction relative to the fixed base as the former undergoes rocking motion along a relatively large arc. This gives a pleasing gliding sensation reminiscent of that produced by porch gliders. In order to allow the seat height of the chair to be designed within a limited range, the distance between the upper pivot joints 54, 56 and lower pivot joints 58, 59 (or the distance between the base and seat links 40, 41 in the specific embodiment) must also be kept within a limited range; however, it was discovered that such limitations could excessively magnify the leverage of the chair and the occupant's momentum during rocking of the chair to produce an unstable condition. In accordance with the invention, it was discovered that the ratio of the distance between the upper pivots 54 and 56 and the distance between the lower pivots 58 and 59 must be such as to be capable of producing a certain obtuse triangle among the four-bar linkage 40, 41, 50 and 52 if the chair were rocked to its rear while being vacant of any occupant. For conventional chair sizes and styling, this triangle which is shown in dotted lines in FIG. 3, must have an angle "a" of at least six degrees (6°) but no greater than sixteen degrees (16°). It has been found that with such specifications, the chair may be easily rocked by the occupant with comfortable gliding action and yet, the occupant's weight will serve to resist any excessive rocking action so as to provide a safe chair. At the same time, the linkage mechanism is fully concealed within the chair without sacrificing low-seat styling requirements or other presentday design criteria. Indeed, the chair of the present invention may take its place in any living or sitting room.

Although the present invention has been illustrated in a chair incorporating a swivel, it will be apparent that the invention may be incorporated in chairs without a swivel. Furthermore, the invention may be incorporated in chairs where the backrest is moveable relative to the seat or in other action chairs such as recliner chairs.

This is illustrated by the embodiment shown in FIGS. 5 and 6 which incorporates a footrest generally designated 104 moveable between a retracted or closed position shown in FIG. 5 and an extended position partially shown in FIG. 6. Additionally, in the specific embodiment shown in FIGS. 5 and 6, the seat frame 102 is moveable into a reclining position when the footrest 104 is extended. Furthermore, in the specific embodiment shown, the backrest 100 is moveable relative to the seat into advanced reclining positions beyond TV position in the manner of a "three-way" reclining chair.

In the embodiment of FIGS. 5 and 6, the linkage system includes a seat link 106 which is fixed to the seat frame 102 by fasteners 107. Seat link 106 and its associated seat frame are suspended from the base generally designated 108 by means of a carrier link 110 and a pair of swing arms or links 112 and 114 whose longitudinal axes are represented by lines A and B in FIG. 6. Swing arms 112 and 114 are pivotally mounted at their upper end by pivots 114 and 116 to the base 108. The lower end of front swing arm 114 is pivotally connected by pivot 116 to the forward end portion of carrier link. The lower end of rear swing arm 112 is pivotally connected by pivot 118 to a mounting link 120 whose intermediate portion is pivotally mounted by pivot 122 to a rear portion of carrier link 110 as best shown in FIG. 6. Carrier link 110 is pivotally connected by link 126 to the front portion **106*a* of seat link 106. Additionally, carrier link 110 is pivotally connected by an arm 130*a* of backrest link 130 to the rear end portion of seat link 106. It will thus be seen that links 106, 110, 126 and 130*a* form a four-bar linkage which is pivotally suspended by swing arms 112 and 114 from the base 108. The base 108 in the specific embodiment shown includes a swivel structure similar to that described above in connection with FIGS. 1 to 4. Backrest 100 includes a frame which, of course, is fixed to backrest link 130**.

In the specific embodiment shown, footrest 104 is mounted to seat link 106 by any suitable lazy-tong or pantograph linkage generally designated 139 including mounting links 140 and 142 pivotally mounted by pivots 144, 146 to front end portions of seat link 106 as best shown in FIG. 6. Footrest linkage 139 may be any conventional linkage which serves to mount the footrest 104 for movement between a retracted position shown in FIG. 5 and an extended position partially illustrated in FIG. 6. If desired, other types of footrest linkages may be employed in place of the conventional lazy-tong type. For example, footrest linkages as shown in my copending U.S. application Ser. No. 06/478,228, filed Mar. 24, 1983, entitled "Footrest Assembly For Recliner Chairs" may be employed; and thus, the disclosure of the aforementioned application is also incorporated herein by reference and made a part hereof.

In the specific embodiment shown, the footrest linkage is actuated from the closed position shown in FIG. 5 to the extended position illustrated in FIG. 6 by means of a handle 150 which is fixed to a shaft 152 suitably mounted in the seat link 106 for rotation. Projecting from shaft 152 is a link 156 which is pivotally connected to a footrest actuating link 160. The latter is pivotally connected at its forward end to an intermediate portion of footrest mounting link 140 to drive the same in a counterclockwise (as viewed in the drawings) direction to open the footrest linkage and project the footrest in response to rotation of shaft 152 achieved by means of the handle 150. The rear end of footrest actuating link 160 is pivotally connected to the upper end of mounting link 120. Although a handle actuator for the footrest has been shown, other types of actuating systems for the footrest linkage may be employed instead. For example, a "gravity" system such as disclosed in my U.S. Pat. Nos. 4,350,387 and 4,350,386 may be employed.

It will thus be seen that in addition to the rocking and gliding action achieved by the chair of FIGS. 1 to 4, the chair of FIGS. 5 and 6 may also be moved to TV position wherein the footrest is extended and the seat and backrest are placed into a reclined position as best illustrated in FIG. 6. In the TV position, the seat and backrest assembly may be rocked to a limited degree in pendulum fashion relative to the base 108 about a fulcrum located at a point above the chair where the axes A and B of swing arms 112 and 114 intersect each other. If it is desired to further recline the chair beyond the TV position, the chair occupant may simply apply back pressure on the backrest 100 which will cause the backrest to pivot rearwardly relative to the seat as the seat moves relative to the base 108. To return the chair to TV position that chair occupant merely leans forward removing pressure from the backrest which will cause the linkage to move into the position shown in FIG. 6. To return the chair to the closed generally upright position, the chair occupant merely applies leg pressure to the footrest 104 to return the same into the closed position shown in FIG. 5. In the closed position, the chair may be rocked and glided relative to the base 108 in the same manner as the chair of FIGS. 1 to 4. Additionally, the chair may also be swivelled about a vertical axis through the swivel structure incorporated in the base 108 similar to that described above in connection with FIGS. 1 to 4.

In addition to the three-way chair disclosed in FIGS. 5 and 6, the present invention may also be incorporated in a one-way recliner chair (not shown). This embodiment may be similar to that of FIGS. 5 and 6 with the exception that the rear end of carrier link 110 would be pivotally connected directly to the seat link 106; and the backrest 100 would be rigidly fixed to the seat frame 102.

Although not shown, other types of recliner chairs and linkages may also be incorporated together with the rocking and gliding linkage systems.

What is claimed is:

1. A rocking chair comprising a base, a seat and backrest structure including a seat frame having opposite side portions, and linkage means suspending the seat at said side portions from the base for rocking movement along an arc during which the seat is also displaced in a horizontal plane relative to the base, a footrest, a footrest linkage mounting the footrest relative to the seat for movement between a retracted position below the seat and an extended position projected forwardly from the seat, and means for actuating the footrest linkage to drive the footrest from the retracted to the extended position, said linkage means suspending the seat from the base includes front and rear swing arms pivoted at upper end portions thereof to the base, and linkage means connecting the swing arms to the seat, including a carrier link, said swing arms having lower portions pivotally connected with the carrier link, and wherein said linkage means connecting said swing arms to the seat includes linkage means mounting the seat to the carrier link.

2. The chair defined in claim 1 wherein said backrest structure includes a backrest and wherein said linkage means connecting said swing arms to the seat includes a backrest link fixed to the backrest and pivotally interconnecting said carrier link and a rear portion of the seat, and a link pivotally interconnecting the carrier link and a front portion of the seat.

3. The chair defined in claim 1 wherein said backrest structure includes a backrest moveable relative to the seat when the footrest is in said extended position.

4. The chair defined in claim 1 wherein said base includes a swivel means mounting the seat for rotation about a vertical axis.

5. The chair defined in claim 3 wherein said base includes a swivel means mounting the seat for rotation about a vertical axis.

6. The chair defined in claim 1 wherein said swing arms have longitudinal axes and said seat is swingable through said swing arms relative to the base about a fulcrum located at the intersection of said swing arm axes when the footrest is in said extended position thereof.

7. The chair defined in claim 1 wherein said swing arms are pivotally connected to the carrier link at pivots spaced apart a distance less than the distance between pivots of the swing arms to the base.

8. A linkage system for a rocking and reclining chair of the type having a base, a seat mounted on the base, a backrest connected to the seat and a footrest mounted to the seat for movement between extended and retracted positions; the linkage system including a seat link adapted to be fixed to the seat, a carrier link below the seat link, linkage means mounting the seat link to the carrier link, a pair of swing arms for pivotally suspending the carrier link from the base for swinging the seat relative to the base, a footrest linkage mounted relative to the seat link for supporting the footrest between extended and retracted positions, and actuating means for driving the footrest linkage.

9. The linkage system defined in claim 8 wherein said linkage means mounting the seat link to the carrier link includes a backrest link adapted to be fixed to the backrest and pivotally interconnecting the carrier and seat links at rear portions thereof, and another link pivotally interconnecting the seat and carrier links at forward portions thereof.

10. A rocking and reclining chair having a base, a seat mounted on the base, a backrest connected to the seat and a footrest mounted to the seat for movement between extended and retracted positions, a linkage system including a seat link fixed to the seat, a carrier link below the seat link, linkage means mounting the seat link to the carrier link, means including a pair of swing arms pivotally suspending the carrier link from the base for swinging the seat relative to the base along an arc during which the seat is also displaced in a generally horizontal direction relative to the base, a footrest linkage mounted relative to the seat link for supporting the footrest between extended and retracted positions, and actuating means for driving the footrest linkage.

11. The rocking and reclining chair defined in claim 10 wherein said base includes a swivel means mounting the seat for rotation about a vertical axis.

* * * * *